United States Patent [19]

Andersen

[11] Patent Number: 4,827,612

[45] Date of Patent: May 9, 1989

[54] METHOD FOR MAKING AN ELECTRICAL CONTACT

[76] Inventor: Stephen Andersen, P.O. Box 11286, Burbank, Calif. 91510-1286

[21] Appl. No.: 161,766

[22] Filed: Feb. 29, 1988

Related U.S. Application Data

[62] Division of Ser. No. 886,233, Jul. 16, 1986, Pat. No. 4,738,026.

[51] Int. Cl.[4] ..... H01R 9/04

[52] U.S. Cl. ..... 29/882; 72/324; 72/326

[58] Field of Search ..... 29/33 M, 874, 882; 72/324, 326, 332; 81/9.41, 9.51; 140/123, 123.6, 123.5

[56] References Cited

U.S. PATENT DOCUMENTS

| | | | |
|---|---|---|---|
| 3,857,142 | 12/1974 | Hills | 72/324 X |
| 4,040,177 | 8/1977 | Beeler et al. | 29/874 |
| 4,621,421 | 11/1986 | O'Loughlin | 29/874 |
| 4,641,514 | 2/1987 | Rozmus | 29/874 X |

*Primary Examiner*—Timothy V. Eley
*Attorney, Agent, or Firm*—James E. Brunton

[57] ABSTRACT

A precision apparatus and method for controllably shearing a thin workpiece of electrically conductive material to make electrical contacts of the character having specially configured spaced apart tongues adapted to mate with plug connectors of standard design. The apparatus is designed to rigidly support the workpiece except in the precise area of the shear during the entire shearing step.

5 Claims, 2 Drawing Sheets

METHOD FOR MAKING AN ELECTRICAL CONTACT

This is a Divisional Application of application Ser. No. 06/886,233, filed July 16, 1986 and now U.S. Pat. No. 4,738,026.

BACKGROUND OF THE INVENTION

1. Field of the Invention

The present invention relates generally to electrical contacts and to a method and apparatus of making the same. More particularly the invention concerns a precision apparatus for making electrical contacts of the character having specially configured spaced apart tongues adapted to mate with plug connectors of standard design.

2. Description of the Prior Art

Various methods have been suggested in the past for the high volume manufacture of electrical contact members. In one common prior art method the contact members are stamped or lanced from a suitable piece of sheet material and the contact tongues formed or coined as necessary. Another method of making electrical contacts by one or more bending operations is described in British patent No. 836,397. Still another method, wherein the electrical contacts are made by splitting a bar of electrically conductive metal longitudinally over a portion of its length to form two contact tongues, is described in U.S. Pat. No. 4,040,177 issued to Beeler et al.

In one form of the aforementioned Beeler et al patent, a portion of the bar to be split is enclosed between two tools. The tools are then moved, sliding along each other perpendicular to the longitudinal dimension of the bar in mutually opposed directions, over a distance which is sufficient to produce the desired splitting. In another method of splitting, the bar to be split is retained over a part of its length such that one end is free, after which a wedge is longitudinally driven into the bar through this end.

Experience has shown that in order to repeatedly produce precision electrical contacts by a splitting or skieving method, it is absolutely essential that the portions of the material immediately adjacent the boundaries of the split or slice be rigidly and positively constrained. Only in this way can a predictable controlled shear split of the material be achieved. The recognition of this problem and its novel solution is at the very heart of the present invention. As will be better appreciated from the discussion which follows, the unique apparatus of the present invention, which closely constrains the starting material along the boundaries of the skieve or split, overcomes the basic deficiencies of the prior art splitting methods, including the Beeler et al method, and for the first time permits the low cost, large volume manufacture of very high quality precision electrical contacts.

SUMMARY OF THE INVENTION

It is an object of the present invention to provide a method and apparatus for the precise manufacture of high quality electrical contacts by means of a closely controlled material skieving or splitting process. More particularly it is an object of the invention to provide an apparatus of novel design for use in making the precision electrical contacts wherein the starting material from which the electrical contacts are made is closely constrained in the area of the shear boundaries so that predictable and precisely controlled shearing of the material can repeatedly be achieved.

It is another object of the present invention to provide a method and apparatus for making electrical contacts of the aforementioned character in which material waste is minimized and manufacturing costs are kept at an absolute minimum.

Another object of the invention is to provide an apparatus of the character described in the preceding paragraphs which is of a simple straightforward design requiring a minimum amount of maintenance.

Still another object of the invention is to provide a method and apparatus of the character described which is easy to use by untrained workmen and is readily susceptible of automating to accomplish very high volume production rates.

BRIEF DESCRIPTION OF THE DRAWINGS

FIG. 8 is a front view of the electrical contact made in accordance with the method of the present invention after final forming over a mandrel or the like.

DESCRIPTION OF THE INVENTION

Figure 1:
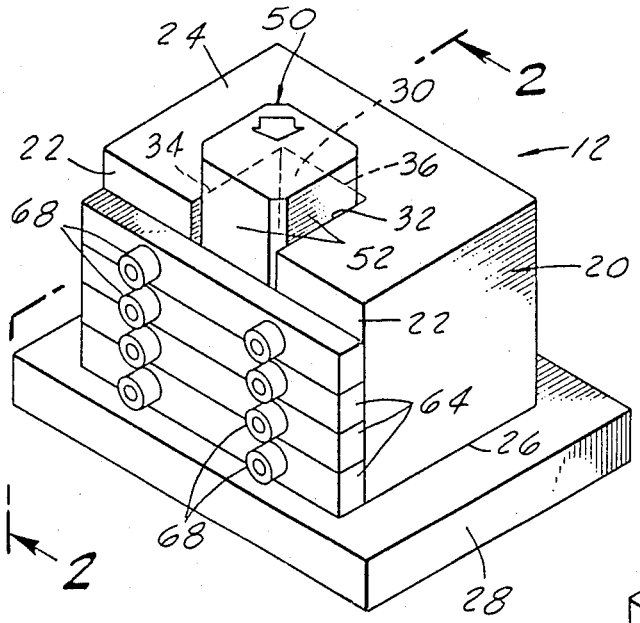
FIG. 1 is a generally perspective view of one form of the apparatus of the invention for forming electrical contacts.
Figure 3:
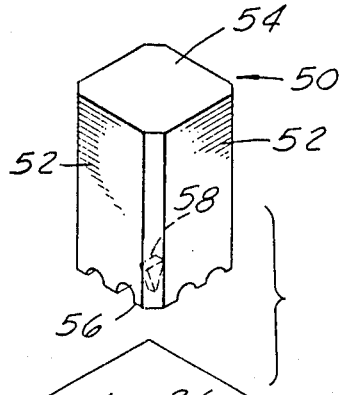
FIG. 3 is an exploded view of the apparatus for making electrical contacts in accordance with the method of the invention.
Figure 3:
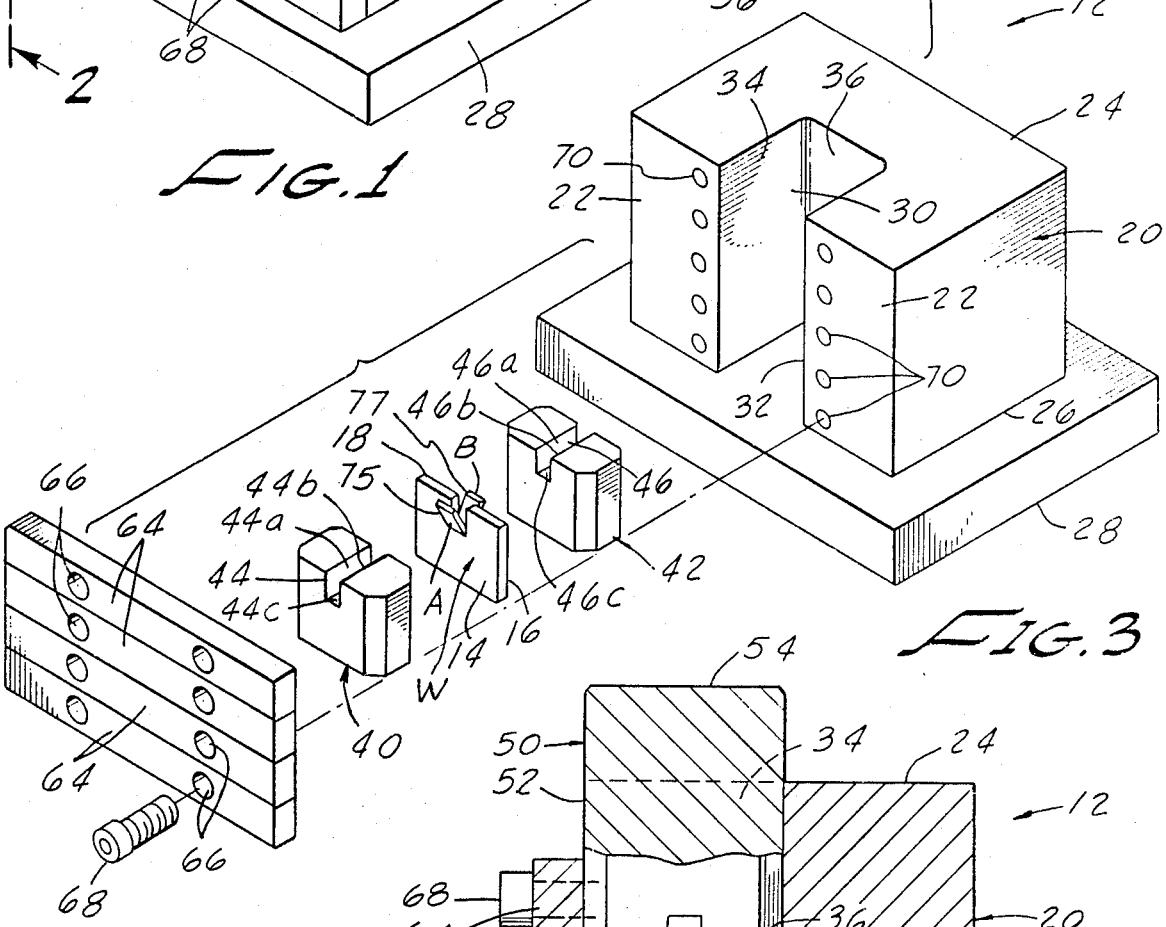
Figure 2:
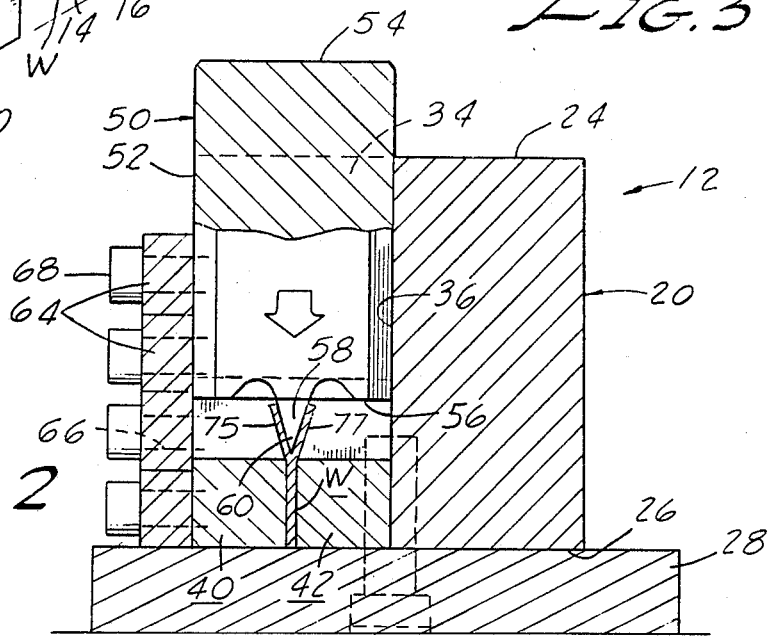
FIG. 2 is an enlarged cross-sectional view taken along lines 2—2 of FIG. 1.

Referring to the drawings, and particularly to FIGS. 1, 2 and 3, one form of the apparatus for making an electrical contact member from a generally planar shaped workpiece of electrically conductive material is generally designated by the numeral 12. As best seen in FIG. 3, the starting material, or workpiece "W", used in the practice of the method of the present invention has first and second generally parallel faces 14 and 16 of a predetermined area terminating in a perpendicularly extending third face, or edge, 18 of a predetermined width.

The apparatus 12 comprises a die portion including a supporting body 20 having a first, or front, face 22, a second, or top, face 24 and a bottom face 26 adapted to rest on a generally planar, rectangular base 28. A vertically extending, generally "U" shaped punch receiving channel 30 is formed in body member 20. As best seen in FIG. 3, channel 30 is defined by transversely spaced, generally parallel side walls 32 and 34 which join with a perpendicularly extending back, or end, wall 6.

Closely receivably within the lower portion of channel 30 are workpiece supporting means for continuously rigidly supporting the first and second faces 14 and 16 of the workpiece "W" In the form of the invention illustrated in FIGS. 1 through 3, the workpiece supporting means comprises supporting elements 40 and 42. Elements 40 and 42 support the entire faces 14 and 16 of the workpiece save in the areas "A" and "B" which correspond to the cross-sectional area of transverse grooves 44 and 46 formed in the elements 40 and 42. Similarly, in the second form of the apparatus of the invention illustrated in FIG. 11, the workpiece supporting means support the first and second faces of the workpiece throughout the entire area of the first and second faces save for an area designated by the letter "C" in FIG. 11. Area "C" on face 14 of the workpiece "W" is of a predetermined width and length corresponding to the width and length of groove 44 formed in element 40. As indicated in FIG. 11 this first unsupported area extends downwardly from the third face, or edge, 18 of the workpiece "W"

It is to be observed that in both the first and second forms of the apparatus of the invention, supporting element 40 is provided with a transversely extending channel 44 therethrough, which channel has a cross-sectional area substantially corresponding to the previously identified unsupported areas "A" and "C" As seen in FIGS. 3 and channel 44 is defined by spaced apart parallel walls **44*a* and 44*b* which join with a perpendicularly extending bottom wall 44*c***.

In the first form of the apparatus of the invention shown in FIGS. 1 through 3, supporting element 42 is also provided with a transversely extending channel 46 which is defined by downwardly extending spaced apart parallel side walls **46*a* and 46*b* which join with in a perpendicularly extending bottom wall 46*c*. As indicated in FIG. 3, the cross-sectional area of channel 46 is equal to unsupported area "B" on face 16 of the workpiece "W" In the discussion which follows, it will become apparent that areas "A" and "B" are equal to the sheared areas, or tongues, formed in th workpiece depicted in FIG. 3, while area "C" is equal to the area of the skived, or tongue, portion formed in the workpiece shown in FIG. 11 and identified therein by the numeral 49**.

Figure 11:
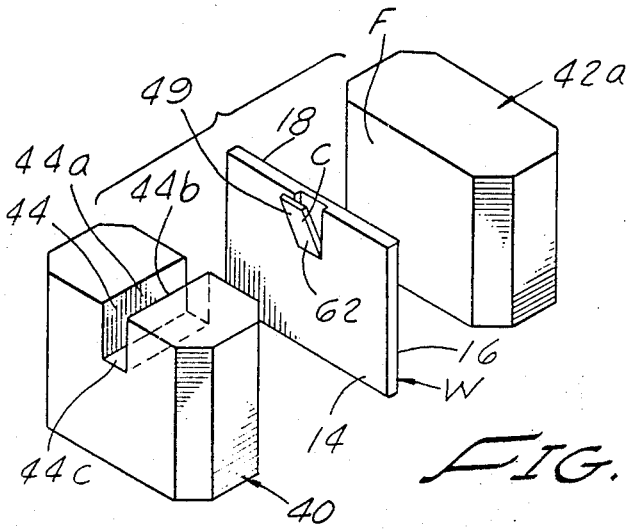
FIG. 11 is an exploded view similar to FIG. 3 showing the appearance of a rough form electrical contact after having been formed using the form of the apparatus of the invention illustrated in FIGS. 9 and 10.

Referring particularly to FIG. 11, it is to be noted that the second supporting element, designated in this figure by the numeral **42*a*, does not have a tansversely extending channel formed therein. Rather, the entire front face "F" of supporting element 42*a* provides support to the entire second, or rear, face 16** of the workpiece "W"

Figure 9:
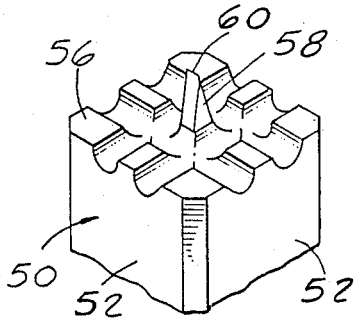
FIG. 9 is a fragmentary perspective view of the form of punch used in connection with a apparatus of the invention shown in FIGS. 1 through 3.

Turning again to FIGS. 1 through 3, the apparatus of the form of the invention thereshown further includes shearing, or punch, means closely receivable within channel 30 of the supporting body 20 for reciprocal movement therewithin. The function of the shearing means is to impart a shearing force to the third face, or edge, 18 of the workpiece "W" at a location intermediate the first and second faces 14 and 16. The shearing means, shown here as punch 50, includes interconnected side walls 52 which terminate in an upper wall 54 and a lower wall 56. As best seen by also referring to FIG. 9, extending downwardly or outwardly from end wall 56 of the punch 50 is a cutter element 58 which has the shape of an isosceles triangle in longitudinal cross-section with the apex thereof terminating in cutting edge 60. As indicated in FIG. 1, punch 50 is closely receivable within channel 30 of body 20 and is controllably movable downwardly in the direction of the arrow of FIG. 1.

Figure 10:
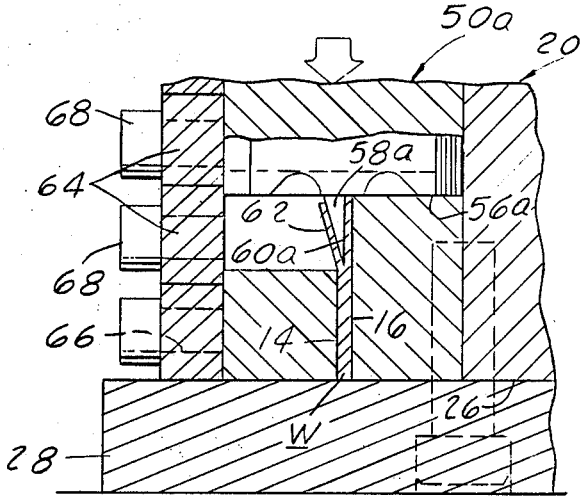
FIG. 10 is a side elevational, cross-sectional fragmentary view of an alternate form of the apparatus of the invention embodying a die similar to that illustrated in FIG. 1. This form of the apparatus of the invention makes use of a slightly different punch and is used in forming the electrical contact by skiveing the material held captive within the die.

In both forms of the apparatus of the invention shown in the drawings, the workpiece clamping or supporting elements 42 and 44 are provided with opposing faces adapted to be brought into pressural engagement with faces 14 and 16 respectively of the workpiece. The supporting or clamping elements 40 and 42 are maintained in pressural engagement with the faces of the workpiece "W" by means of a plurality of stacked bars 64 which are interconnected with face 22 of body 20. As best seen in FIGS. 3 and 10, each of the bars 64 is provided with spaced apart apertures 66 which receive threaded connectors 68, which connectors are threadably received within internally threaded apertures 70 formed in the forward face 22 of body 20. As indicated in FIG. 1, with stacked bars 64 securely affixed to supporting body 20 in the manner shown, punch 50 is closely receivable within an area defined by the rear face of stacked bars 64 and the side and end walls 34 and 36 of channel 30.

Turning once again to FIG. 10, wherein a second form of the apparatus of the invention is shown, the punch, there designated by the numeral **50*a*, is of similar construction to punch 50 having a lower end wall 56*a*. Extending outwardly or downwardly from end wall 56*a* is a cutter element of slightly different configuration from that shown in FIGS. 3 and 9. More particularly, this cutter element, designated by the numeral 58*a*, has the longitudinal cross-sectional shape of a right triangle terminating at its apex in a cutting edge 60*a*. As will presently be discussed, the apparatus of the second form of the invention shown in FIGS. 10 and 11 is used in skiving, or slicing, the workpiece "W" in a predeterminable controlled manner to form a tongue 62 (FIG. 11**).

In practicing the method of the invention using the apparatus of the form of the invention shown in FIGS. 1 througb 3, after the clamping bars 64 are removed from the face of the die body 20 supporting element 42 is inserted into the lower portion of "U" shaped channel 30 with its base resting on base 28. The workpiece "W" is next inserted into the "U" shaped channel with face 16 thereof in surface contact with the outwardly extending face of supporting element 42. With the workpiece in place, supporting element 40 is then inserted into channel 30 of the die body so that the rear face thereof is in intimate contact with the front face 14 of the workpiece "W" Next, the clamping bars 64 are interconnected with the front face 22 of the die body 20 by means of theaded connectors 68 so as to securely clamp the workpiece between elements 40 and 42. It is important to note that with the workpiece clamped in the die in the manner thus described, the first and second faces of the workpiece are firmly and securely supported throughout the entire area of their opposing faces save for the first unsupported area "A" and the second unsupported area "B" (FIG. 3) which are coextensive with the cross-sectional areas of transversely extending grooves 44 and 46 formed in supporting elements 40 and 42.

With the workpiece supported within the die in the manner described in the preceding paragraphs, the punch 50 is then inserted into the channel defined by the rear faces of clamping bars 64 and the faces of the "U" shaped channel 30 formed in die body 20. In the embodiment of the invention shown in FIGS. 1 through 3, the cutting portion 58 of the punch 50, which is in the cross-sectional shape of an isosceles triangle, contacts the workpiece "W" so that the cutting edge 60 precisely bisects the upper edge portion 18 of the workpiece. A downward force exerted on the punch 50 in the direction of the arrow in FIG. 1 will cause the workpiece to be sheared in the manner shown in FIGS. 2 and 3 forming angularly diverging tongues 75 and 77. After shearing, tongue 75 will have an area precisely equal to the area "A" which, as previously noted, is equal to the cross-sectional area of groove 44. Similarly, tongue 77 will have an area "B" which is precisely equal in area to the cross-sectional area of groove 46 formed in support element 42.

An important aspect of the present invention resides in the fact that because the workpiece "W" is rigidly clamped between supporting elements 40 and 42 with faces 14 and 16 being supported throughout their entire areas, save for the areas "A" and "B", the downward force of the punch 50 effects a true shearing action of the unsupported areas "A" and "B" along side shearlines which are coextensive with the transversely spaced edges of the grooves 44 and 46 respectively. This positive support of the workpieces immediately adjacent the shearlines of areas "A" and "B" permits a degree of precise repeatability which is not possible with prior art devices presently in use.

Turning now to FIGS. 10 and 11, the apparatus of this form of the invention is used to controllably skieve a layer of the workpiece "W" to form a tongue having a predetermined precisely controlled width and length. As indicated in FIG. 10, the support elements 40 and **42*a* are supported within in die body 20 in the same manner as previously discussed herein. However, in this form of the invention, support element 42*a* provides support to the entire rear face 16 of the workpiece, while support element 40 provides support to the face 14 of the workpiece "W" throughout its entire area, save the unsupported area designated in FIG. 11 by the letter "C" As previously mentioned, this unsupported area is coextensive with the cross-sectional area of the groove 44 formed in support element 40**.

In addition to the different manner in which the workpiece "W" is supported in the apparatus of the second form of the invention, it is to be noted that punch **50*a* is also of a different configuration. More particularly, the cutting element of punch 50*a*, while in the shape of a triangle in longitudinal cross-section, takes the shape of a right triangle, rather than an isosceles triangle, with the apex of the triangle forming the cutting edge 60*a***.

Once the workpiece "W" is securely clamped between clamping elements 40 and **42*a*, a downward pressure on punch 50*a* in the direction of the arrow in FIG. 10 will bring the cutting edge 60*a* into contact with the upper edge 18 of the workpiece "W" at a precisely determined location intermediate faces 14 and 16 of the workpiece. A continued downward force on punch 50*a* will cause the controllable skieving of a layer of material having an area "C", which area is coextensive with the cross-sectional area of the groove 44 formed in clamping element 40. Once again, because the entire area of faces 14 and 16 of the workpiece are positively supported, save for the area designated by the letter "C", a downward movement of the punch 50*a* will cause a precise skieving of a layer of material of predetermined thickness to form a tongue of the character designated by the numeral 49 in FIG. 11. This precise skieving of the material can be reproduced time after time because of the rigid support and positive constraint of the workpieces in the immediate proximity of the shearline defined by the edges of groove 44 in element 40**.

Figure 4:
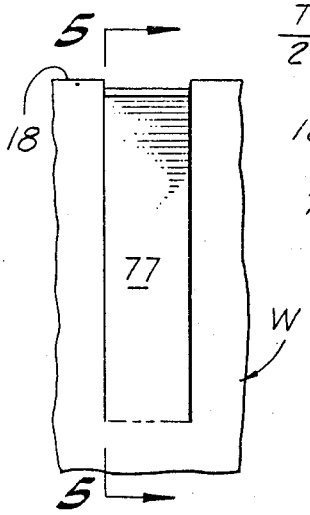
FIG. 4 is a fragmentary view of the rough form electrical contact made an accordance with the method of the invention.
Figure 5:
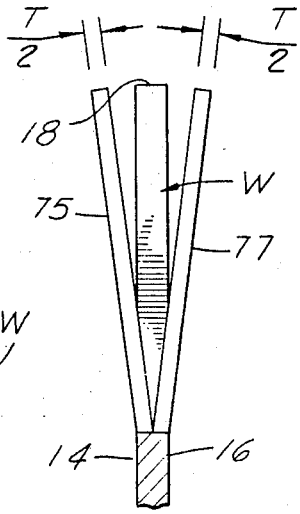
FIG. 5 is a cross-sectional view taken along lines 5—5 of FIG. 4.
Figure 6:
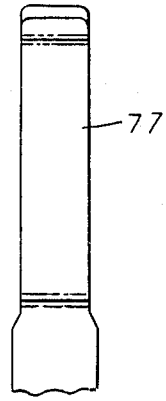
FIG. 6 is a fragmentary side elevational view of the electrical contact after blanking, coining and pre-forming.
Figure 7:
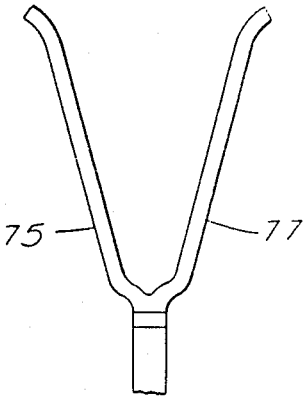
FIG. 7 is a front view of the electrical contact further showing the configuration of the contact after coining and pre-forming.
Figure 8:
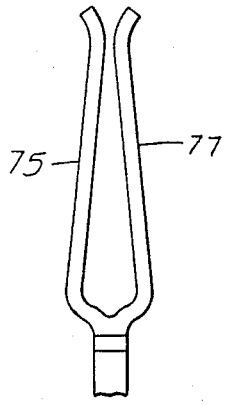

Following the shearing, or skieving, of the workpiece in the manner described in the preceding paragraphs, the electrical contact is finished in the manner illustrated in FIGS. 4 through 8. Referring particularly to FIGS. 4 and 5, after shearing the workpiece "W" using the apparatus of FIGS. 1, 2 and 3, the rough electrical contact thus formed has angularly diverging tongues 75 and 77 each having a thickness of one-half the thickness of the workpiece "W" Following the shearing step, the workpiece is removed from the die, the tongues 75 and 77 are bent into a closed position and the contact is blanked to the desired contour as, for example, that shown in FIG. 6. Next the tongues 75 and 77 are, once again, spread apart and the contact is coined and preformed into the desired configuration as for example that shown in FIG. 7. Finally, as a last step in forming the electrical contact, the contact of the configuration shown in FIG. 7 is bent into final form over a mandrel, or the like, to form the contact in a final configuration as, for example, that shown in FIG. 8.

Figure 12:
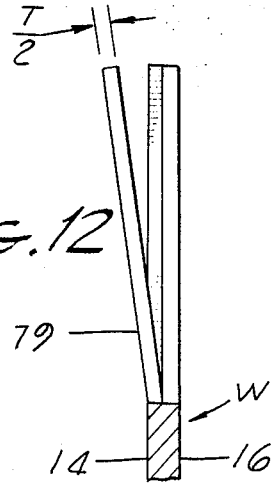
FIG. 12 is a side view, partly in section, of the rough form electrical contact made by the skiving method using the apparatus of FIGS. 9 and 10.

Referring now to FIG. 12, it is to be understood that the rough electrical contact thereshown was formed by the skieving method using the apparatus illustrated in FIGS. 10 and 11. This electrical contact includes an outwardly extending tongue 79 having a thickness approximately equal to one-half the thickness of the starting workpiece "W" The rough electrical contact of the configuration illustrated in FIG. 12 is prefinished into the desired final configuration in the same generaly manner as previously discussed in connection with the finishing of the contact depicted in FIG. 5.

It should be appreciated that the apparatus shown in the drawing is, for sake of simplicity, depicted as a single punch and die acting upon a single discrete workpiece "W" In the actual commercial practice of the method of the invention, the apparatus would be mechanized so that a continuous length of starting material would be fed through an automated punch and die apparatus to continuously shear or skieve the material to form rough contacts which would then be configured and formed into end product electrical contacts on a continuous basis. However, because the production apparatus forms no part of the present invention, the details thereof are neither shown in the drawings, nor described herein.

It should also be observed that the configuration of the electrical contacts as shown in FIGS. 4 through 8 and 12 are exemplary only. The apparatus of the invention can be used to produce electrical contacts having a wide variety of tongue shapes and thicknesses depending upon the end use to be made of the contacts.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making an electrical contact member from a generally planar shaped workpiece of electrically conductive material having first and second generally parallel faces of a predetermined area terminating in a perpendicularly extending third face of a predetermined width comprising the steps of:

(a) continuously rigidly supporting said first and second faces of the workpiece throughout the entire area thereof save for a first unsupported area of predetermined width and length on one of said first and second faces extending away from said third face to prevent lateral deformation of said first and second faces save for deformation in said area of predetermined width and length located on one of said first and second faces;

(b) imparting a shearing force to said third face of said generally planar shaped work piece at a location along the width of said unsupported area and intermediate said first and second faces to controllably skieve a layer of the material to form a first tongue having a width and length substantially corresponding to the width and length of said first unsupported area; and (c) mechanically forming said first tongue into a desired configuration.

2. A method as defined in claim 1 in which said front and rear faces of said workpiece are continuously rigidly supported save in said first unsupported area and save in a second unsupported area of a predetermined width and length on the other of said one of said first and second faces extending away from said third face and located opposite said first unsupported area, whereby imparting a shearing force to said third face of said generally planar shaped work piece at a location intermediate said first and second faces will permit lateral deformation of the material in both said first and second unsupported areas to form a first and second tongue each having a width and length substantially corresponding to the width and length of said first and second unsupported areas; and mechanically forming said second tongue into a desired configuration.

3. A method as defined in claim 2 which said shearing force is imparted to said third face of said generally planar shaped workpiece in a manner to simultaneously form six generally planar surfaces defining the edges and inner opposing surfaces of said tongues.

4. The method as defined in claim 3 in which said shearing force is imparted to said third face of said generally parallel shaped workpiece in a manner to produce a burnishing of the sheared surfaces of said tongues to form a highly polished surface thereon.

5. A method of making an electrical contact member having first and second tongues from a generally planar shaped workpiece of electrically conductive material having first and second generally parallel faces of a predetermined area terminating in a third face of a predetermined width, comprising the steps of:

(a) supporting said first and second faces of the workpiece, save for an unsupported area of predetermined width to prevent lateral deformation of said first and second faces save for deformation in said area of predetermined width;

(b) imparting a shearing force to said third face of said generally planar shaped workpiece at a location along the width of said unsupported area and intermediate said first and second faces in a manner to simultaneously form six generally planar surfaces defining the edges and inner opposing surfaces of the first and second tongues of the electrical contact member.

* * * * *